US008235347B2

(12) United States Patent
Austin, III et al.

(10) Patent No.: US 8,235,347 B2
(45) Date of Patent: Aug. 7, 2012

(54) ADJUSTABLE GROUND ANCHOR

(75) Inventors: James Allen Austin, III, High Point, NC (US); Charles A. Patterson, Durango, CO (US); Michael Reedy, Chicago, IL (US); Victor Hoernig, Lowell, IN (US)

(73) Assignee: Liberty Hardware Mfg. Corp., Winston-Salem, NC (US)

( * ) Notice: Subject to any disclaimer, the term of this patent is extended or adjusted under 35 U.S.C. 154(b) by 363 days.

(21) Appl. No.: 12/564,967

(22) Filed: Sep. 23, 2009

(65) Prior Publication Data

US 2011/0068236 A1 Mar. 24, 2011

(51) Int. Cl.
*F16M 13/00* (2006.01)

(52) U.S. Cl. ..... 248/545; 248/156

(58) Field of Classification Search ..... 248/156, 248/545, 530

See application file for complete search history.

(56) References Cited

U.S. PATENT DOCUMENTS

| | | | | |
|---|---|---|---|---|
| 2,270,325 | A * | 1/1942 | Matthews | 174/7 |
| 4,920,897 | A * | 5/1990 | Reed et al. | 108/150 |
| 6,820,379 | B1 * | 11/2004 | Krinner et al. | 52/157 |
| 6,871,455 | B1 * | 3/2005 | Cockman et al. | 52/165 |
| 6,925,754 | B1 * | 8/2005 | Tearoe | 47/47 |
| 2007/0267552 | A1 * | 11/2007 | Meyer | 248/156 |

* cited by examiner

*Primary Examiner* — Ramon Ramirez

(74) *Attorney, Agent, or Firm* — Carlson, Gaskey & Olds, P.C.

(57) ABSTRACT

A mailbox support has an attachment for attaching the mailbox support to the ground, a first plate attached to the attachment, a second plate rotatably attached to the first plate, a fixture attaching to the second plate for supporting the mailbox support and, an abutment for limiting rotation of the second plate relative to the first plate and for assisting in installing the attachment to the ground. A method for installing a support into the ground includes placing a first plate on a second plate, the second plate having an attachment for attaching the second plate to the ground, and utilizing the first plate and the second plate to drive the attachment into the ground. The first plate and the second plate are joined so that first and second plates may rotate relative to each other to properly orient the first plate.

13 Claims, 12 Drawing Sheets

ADJUSTABLE GROUND ANCHOR

REFERENCE TO RELATED APPLICATION

Cross reference is made to copending U.S. patent application Ser. No. 12/564,975 entitled "Support Arm Positioning Tab"; Ser. No. 12/564,994 entitled "Mailbox Adjustable Mounting Bracket" and Ser. No. 12/565,002 entitled "Slide in Locking Newspaper Box".

BACKGROUND OF THE INVENTION

Some rural and suburban areas utilize curbside mailboxes. Mailboxes generally have a large metal box mounted on a support designed primarily to receive quantities of incoming mail. Some rural curbside mailboxes may be grouped together at property boundaries or road/driveway intersections, depending upon conditions.

Mailboxes evolved to reduce the time required for a mail carrier to complete delivery when the front door of a residence is some distance from the street. Mail boxes are mounted curbside on suitable posts or other supports and may be fitted with a signal flag or semaphore arm—usually red or fluorescent orange that is raised by the resident of the property to notify the postman of outgoing mail and by the postman to inform the recipient that incoming mail had been delivered.

Mailboxes exist under harsh conditions and are subject to extreme stresses: people back into them and run them over; snow plows pack tons of ice and snow against them; the sun bakes them; storms pelt them and can rip them from the ground; lawn mowers and string trimmers attack their supporting posts; animals and insects like wasps live in them; and vandals blow them up, paint-ball them and attack them with bats; among other things. Mailboxes need to be replaced frequently.

Moreover, new home construction continues in rural and suburban areas and new mailboxes are in demand.

SUMMARY OF THE INVENTION

A mailbox support has an attachment for attaching the mailbox support to the ground, a first plate attached to the attachment, a second plate rotatably attached to the first plate, a fixture attaching to the second plate for supporting the mailbox support and, an abutment for limiting rotation of the second plate relative to the first plate and for assisting in installing the attachment to the ground.

According to further non-limiting embodiment, a method for installing a support into the ground includes placing a first plate on a second plate, the second plate having an attachment for attaching the second plate to the ground, and utilizing the first plate and the second plate to drive the attachment into the ground.

According to an aspect of the method, the first plate and the second plate are joined so that first and second plates may rotate relative to each other to properly orient the first plate.

BRIEF DESCRIPTION OF THE DRAWINGS

The various features and advantages of the disclosed examples will become apparent to those skilled in the art from the following detailed description. The drawings that accompany the detailed description can be briefly described as follows.

DETAILED DESCRIPTION OF THE PREFERRED EMBODIMENT

Figure 1:
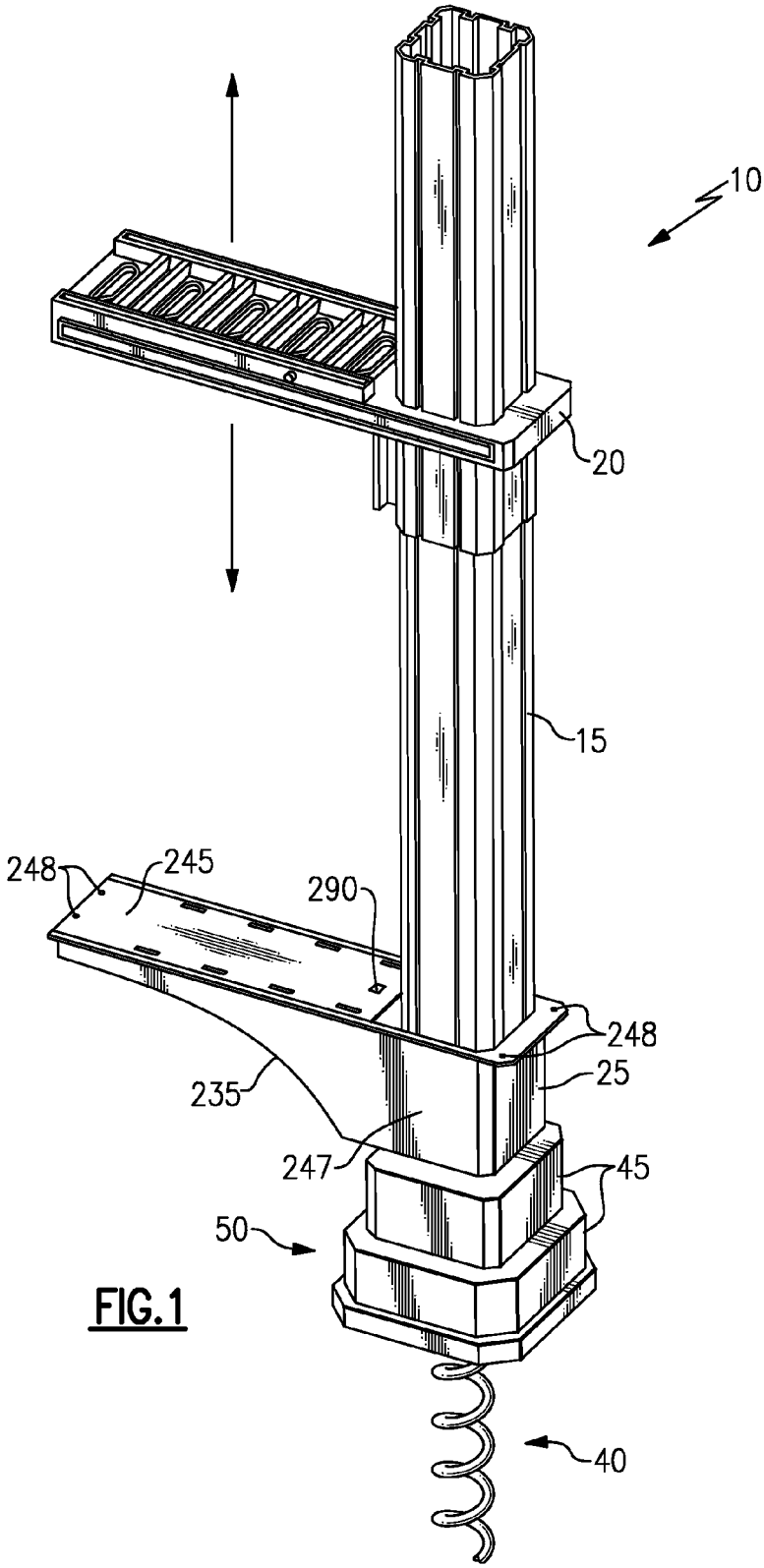
FIG. 1 is a perspective, disassembled view of an embodiment of a mailbox support.
Figure 2:
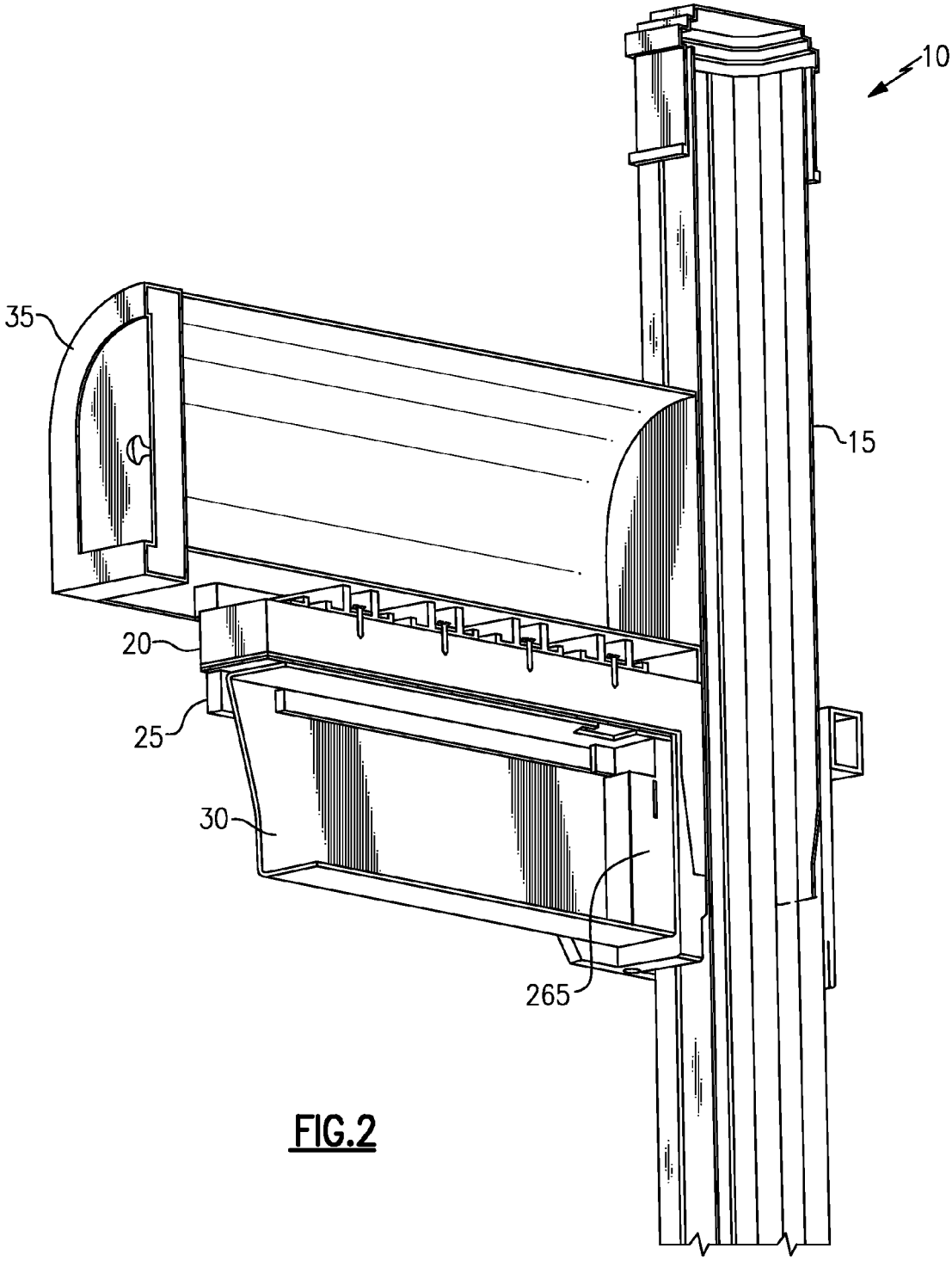
FIG. 2 is an assembled, cutaway view of the mailbox support of FIG. 1 including a mailbox.
Figure 3:
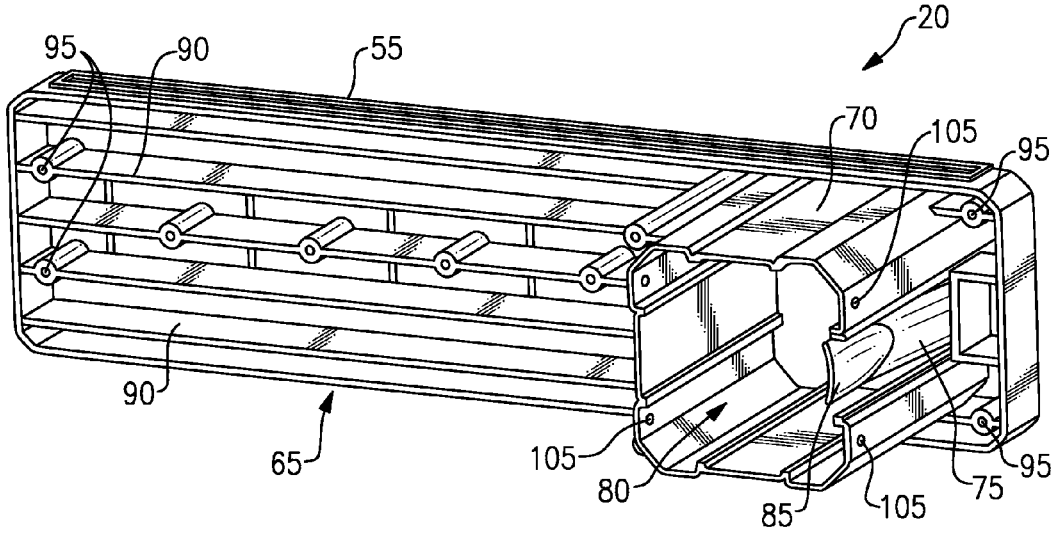
FIG. 3 is a perspective view of an upper support of FIG. 1.
Figure 4:
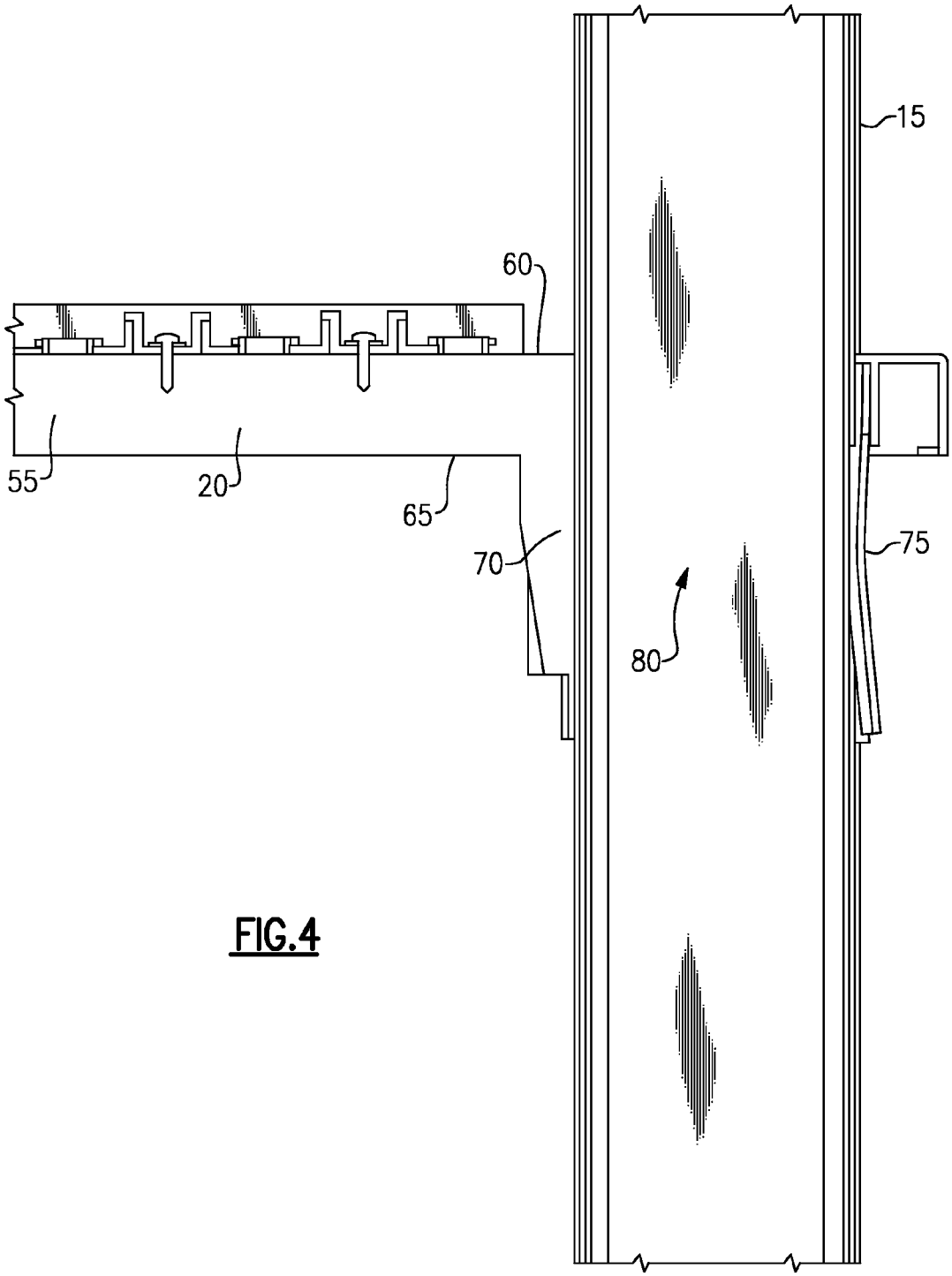
FIG. 4 is a cutaway view of an installed upper support.

Referring to FIGS. 1 and 2 the mailbox support of the invention is shown. The mailbox support 10 has a post 15, an upper support 20, a lower support 25, a newspaper box 30, a mailbox 35 and an anchoring system 40. The post, the upper mailbox support, the mailbox, the newspaper box and the lower mailbox support may be extruded or molded from any suitable material such as PVC or aluminum. The post, which is extruded, may have a pair of decorative stanchions 45 that hide a bottom portion 50 of post and the anchoring system 40.

Referring now to FIGS. 1-5, the upper support 20 is shown. The upper support has an injection molded rectangular body 55 that has a top 60, a bottom 65, and a downwardly extending rectangular portion 70 that looks like a downspout of a gutter. The rectangular portion 70 is designed to fit over the post 15 (see FIG. 4) and be anchored thereon. The rectangular portion has a friction tab 75 that extends downwardly from the bottom 65 and extends inwardly along its length into an opening 80 within the rectangular portion 70. The friction tab 75 has a rounded raised portion 85 (though other shapes are contemplated) to enable a user to manipulate the friction tab if installing the lower support 20. Because of the nature of the material of the friction tab, the friction tab is flexible and if moved, the friction tab tends to move back to its original position.

The bottom 65 of the upper support 20 has a plurality of reinforcing ribs 90 and openings 95 (see FIG. 3) that receive screws (not shown) to attach the lower support 25 as will be discussed hereinbelow. During installation of the upper support 20, the rectangular portion 70 is slid down the post 15. US Postal Service regulations require that the upper support and the mailbox 35 placed thereon (see FIG. 2), be disposed between 41 and 45 inches above the ground. This height enables a mail person to easily insert mail (not shown) into the mailbox. An installer may slide the upper support 20 to an approximate height, and the friction tab engages the post 15 (see FIG. 4) so that the upper support 20 tends to stay in place while the installer looks for a tape measure (not shown) to install the upper support at the proper height. This way the installer does not need "three hands" to do the job. Once the upper support is in position, the installer drives screws (not shown) through holes 105 disposed in the rectangular portion 70 of the upper support to secure the upper support to the post 15. If the upper support is not in the proper position, the installer simply lifts the friction tab 70 by means of raised portion 85 and slides the upper support to the proper height for installation.

Figure 5:
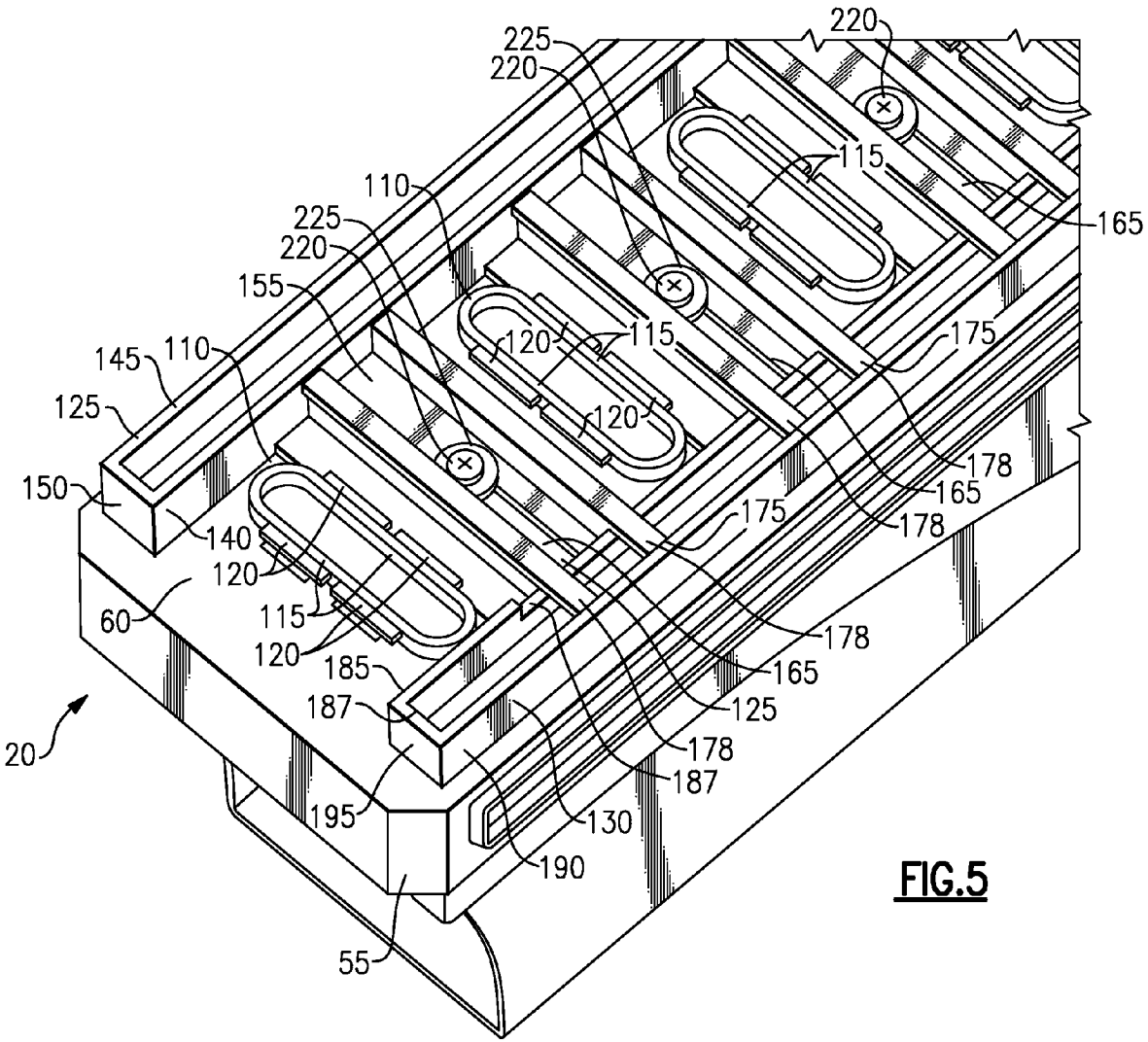
FIG. 5 is a top perspective view of the upper support of FIG. 1.
Figure 6:
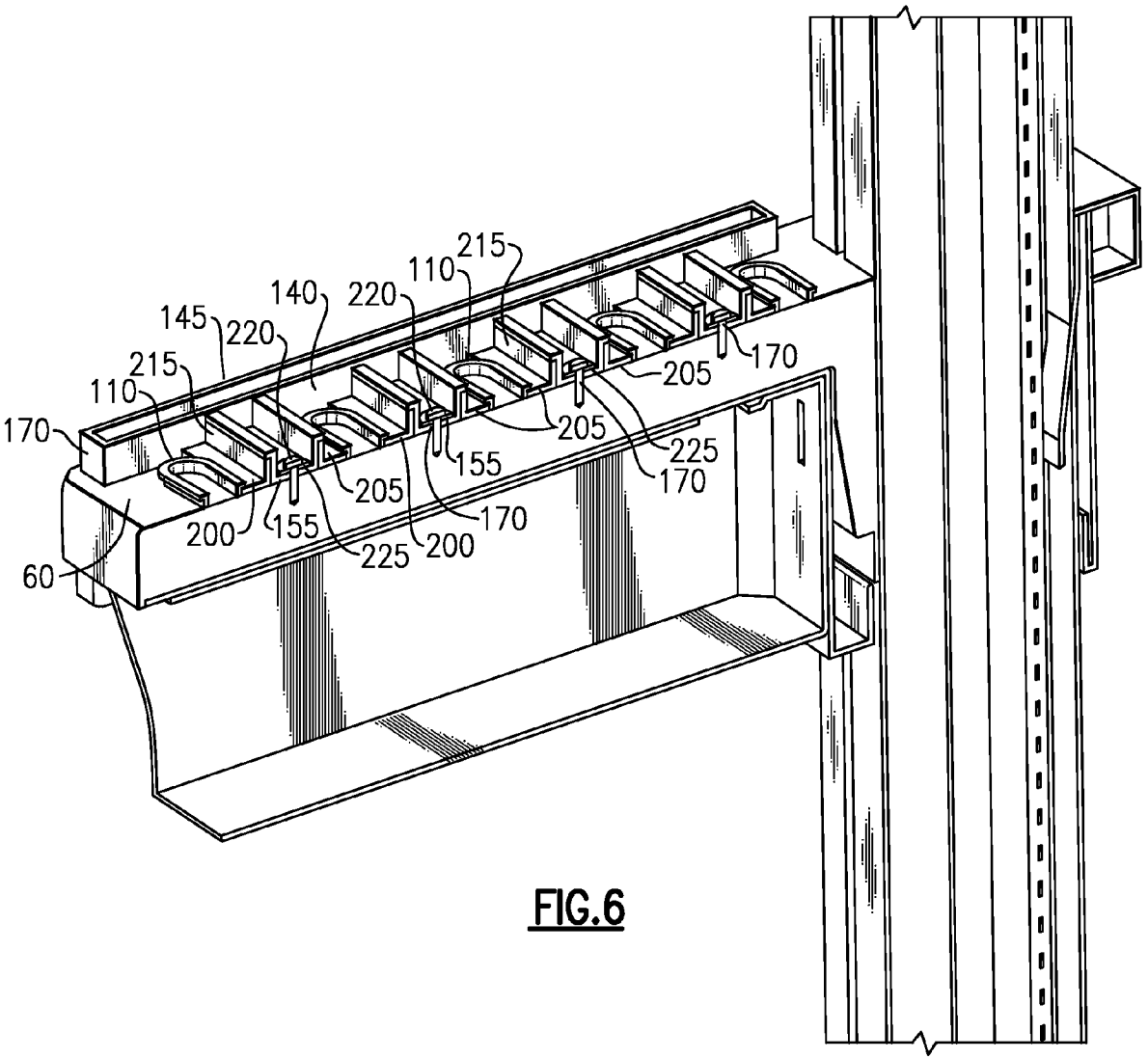
FIG. 6 is a perspective, cutaway view of the upper support of FIG. 1.
Figure 7:
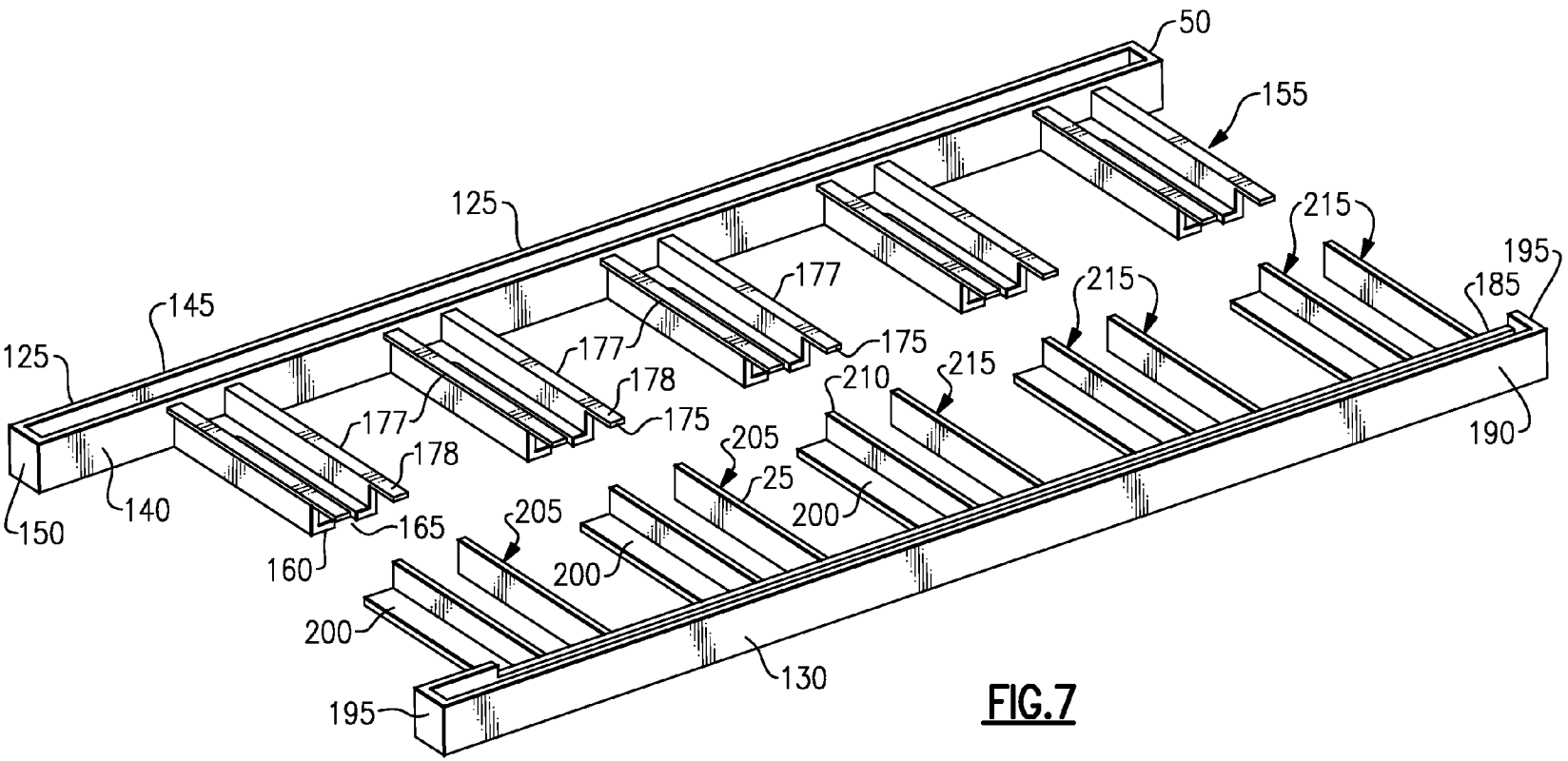
FIG. 7 is a perspective view of the upper support of FIG. 6.

Referring now to FIGS. 5, 6 and 7, the top 60 of the upper support 20 is shown. The top has a plurality of raised races 110 molded therein. The races have straight-aways 115 that each have a pair of tabs 120 extending parallel to the top 60 therefrom.

Figure 8:
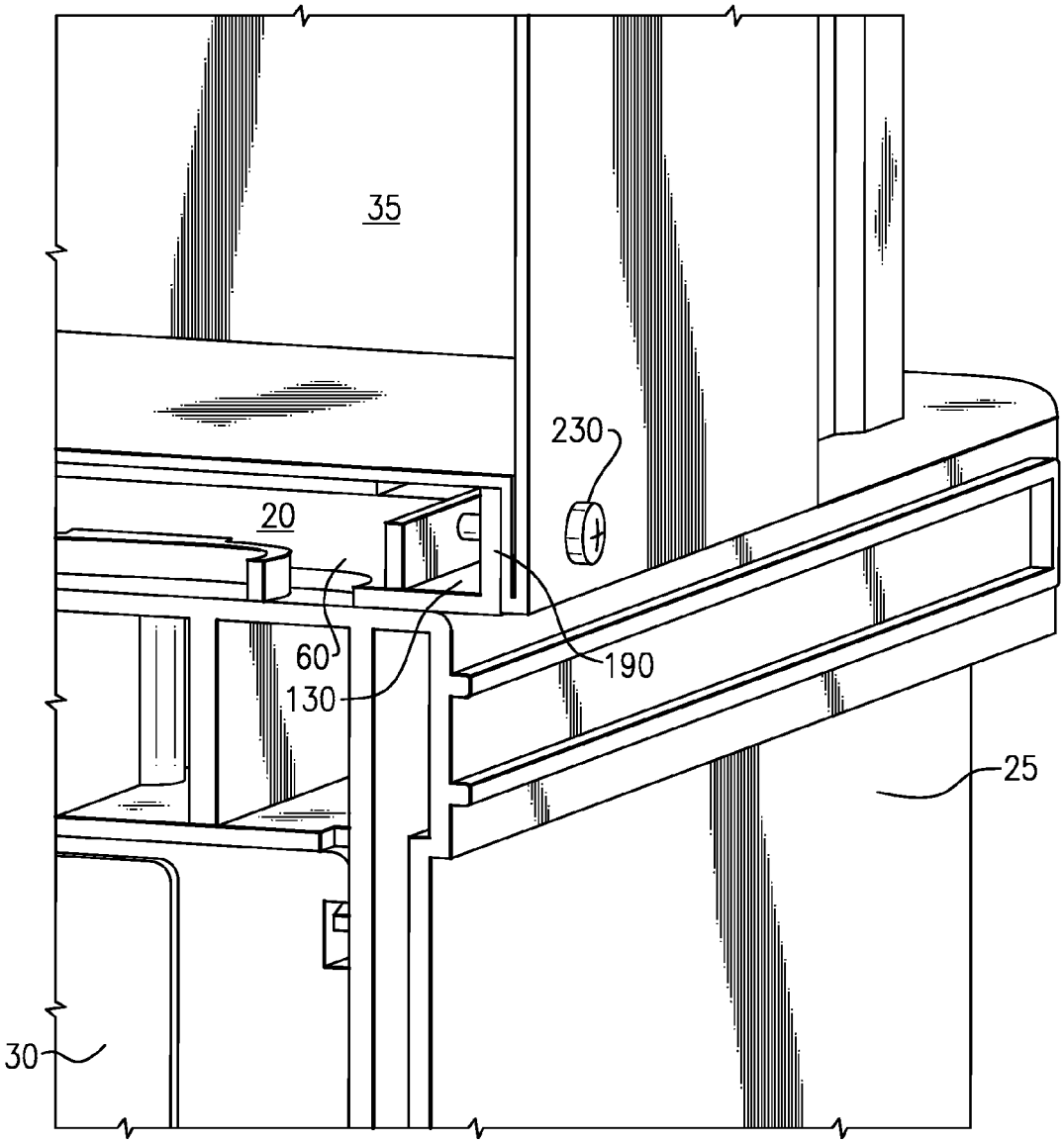
FIG. 8 is a perspective, cutaway view of an installed mailbox on the upper support of FIG. 2.

A left bracket 125 and a right bracket 130 are disposed on the top 60 and cooperate with the tabs 120 so that the brackets may be manipulated by an installer user to adjust inwardly or outwardly to fit the width of the mailbox (see FIGS. 2 and 8).

The left bracket 125 has an inner longitudinal wall 140 and an outer longitudinal wall 145 that are connected by end walls 150. The inner longitudinal wall 140 has a plurality of inverted top-hat shaped extensions 155 extending therefrom towards the right bracket 130. The top hat has a top 160 that has a slot 165 that extends from a middle 170 of the extension through an end 175 distal from the inner longitudinal wall 140 (see FIG. 5). The top-hat shaped extensions 155 also have brims 177. Each top hat is cut away (see FIGS. 5 and 7) to allow brim extensions 178 to extend into the right bracket as will be discussed hereinbelow.

The right bracket 130 has an inner longitudinal wall 185 and an outer longitudinal wall 190 that are connected by end walls 195. The inner longitudinal wall 140 has a plurality of alternating L-shaped extrusions 200 and horizontally flipped L-shaped extrusions 205 extending therefrom towards the left bracket 125. Each L-shaped extrusion and horizontally flipped L-shaped extrusion has a rectangular vertical side portion (see FIGS. 6 and 7) 215 extending upwardly from the bottom portion 210. The inner longitudinal wall 185 has a cut-out portion 187 to hold the top hat extensions 178.

To install the left bracket 125 and right bracket 130 on the top 60 of the upper support 60, the bottom portions 210 of each alternating L-shaped extrusions 200 and horizontally flipped L-shaped extrusions 205 are inserted between the top 60 and the tabs 120 extending from the straight-aways 115. The brims 177 of each top hat shaped extension 155 engage the top of the vertical side portions 215. At this point the left and right brackets may slide laterally to approximate the width of a mailbox (See FIG. 8). Once the left and right brackets are in the desired position, screw 220 is driven through the slot 165 through washer 225 into the top portion 20 to anchor the left bracket 125 to the top 60 and to have the brims 177 of each top hat shaped extension 155 engage the top of the vertical side portions 215 so that the left bracket is also anchored to the top 60. The brim extensions 178 allow the left bracket 125 and the right bracket 130 to be engaged even if the brackets are pulled apart widely to accommodate a wider mailbox 35.

Referring to FIG. 8, once the left bracket 125 and the right bracket 130 are anchored to the top 60, the mailbox 35 is inserted over the outer longitudinal wall 145 of the left bracket 125 and the outer longitudinal wall 190 of the right bracket 130, screw(s) 230 are inserted through the mailbox into the outer longitudinal wall 190 thereby anchoring the mailbox to the upper support 20.

Figure 9:
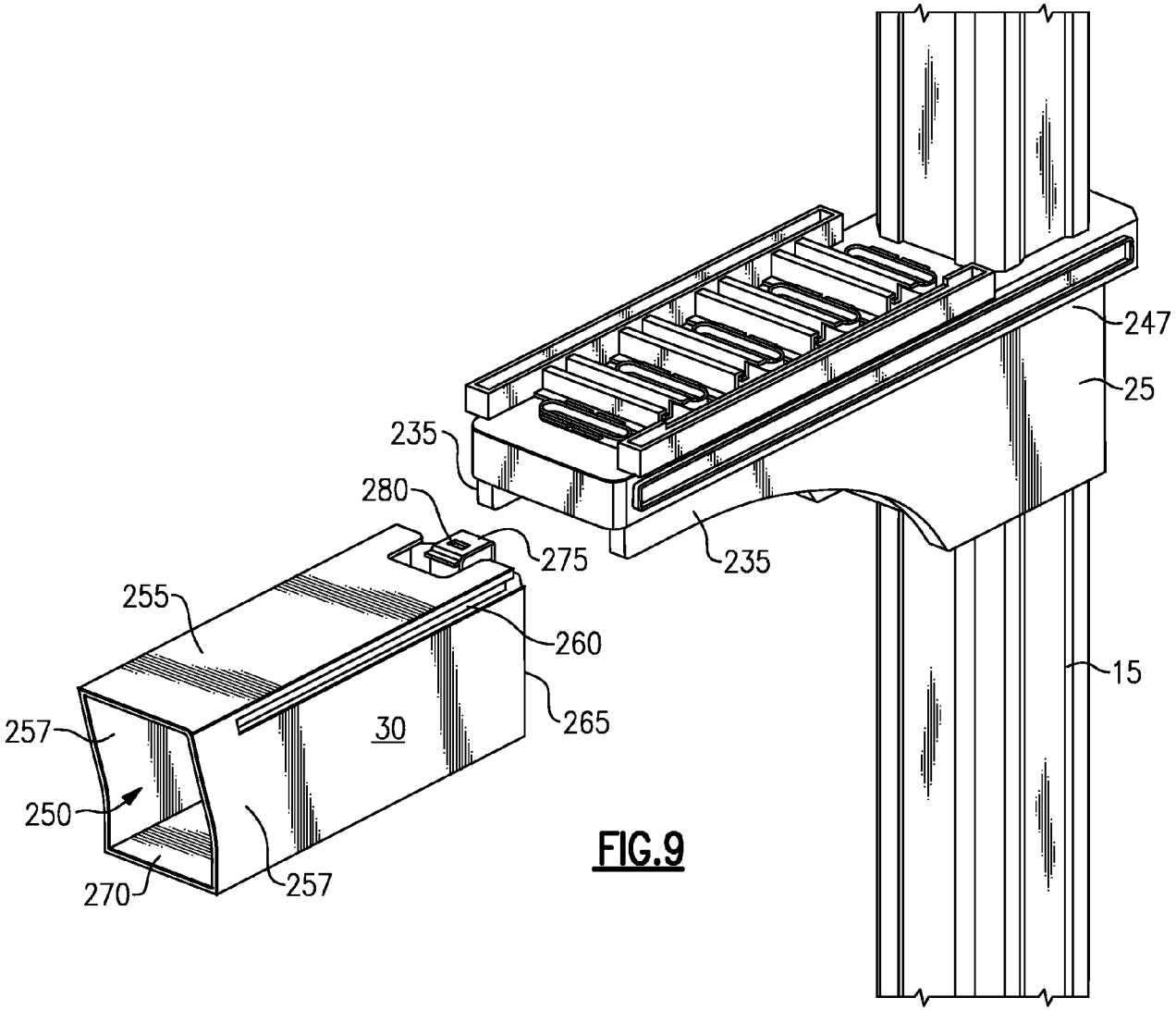
FIG. 9 is a perspective view of a newspaper box of FIG. 2.
Figure 10:
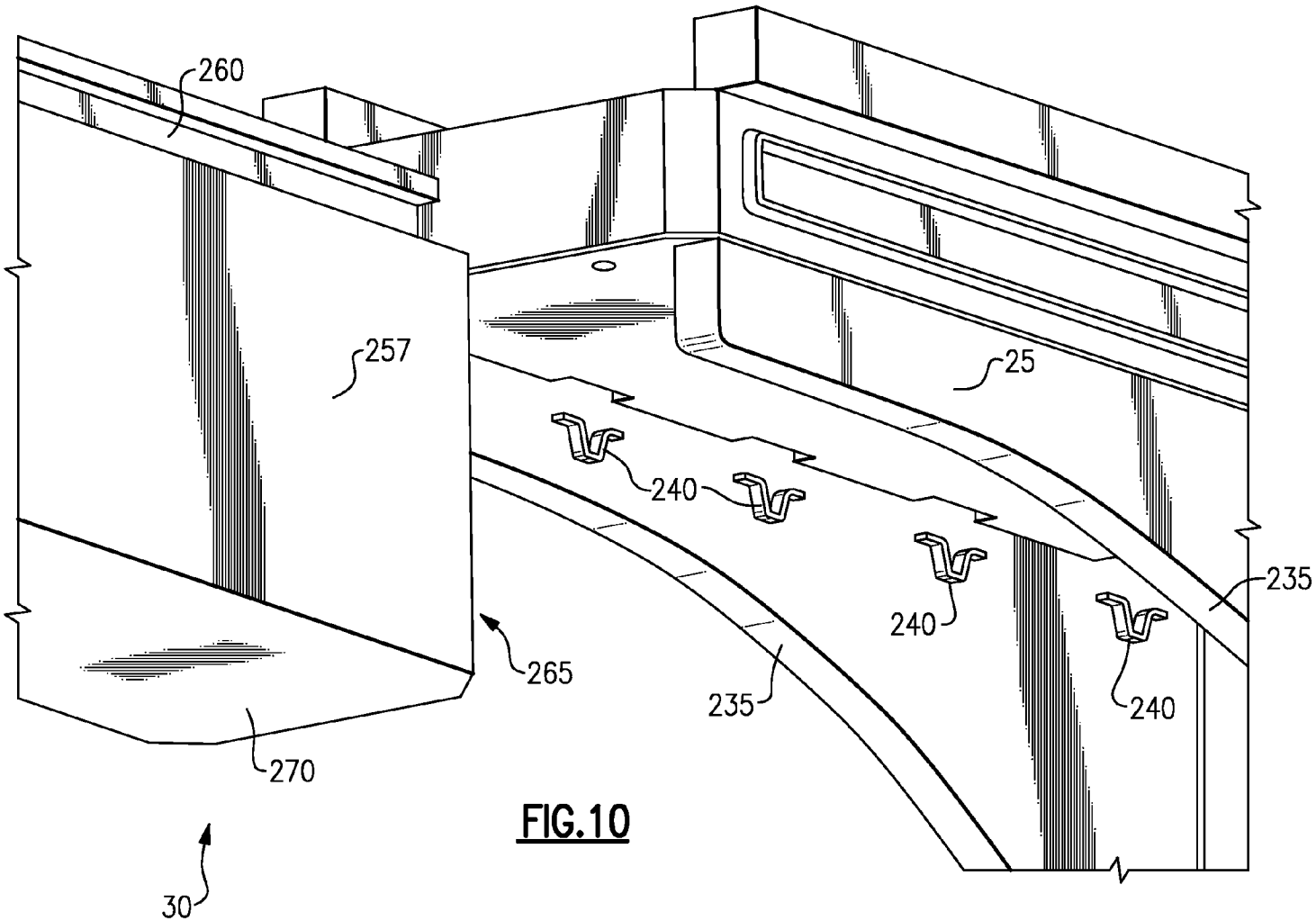
FIG. 10 is a perspective view of the newspaper box of FIG. 9 and the lower support of FIG. 2.

Referring to FIGS. 1, 9 and 10, the lower support 25 is shown. The lower support has a pair of side arms 235, each side arm having a plurality of molded support ribs 240 (see FIG. 10), a top portion 245, a rectangular downwardly extending portion 247 that fits over the post 15 and the downwardly extending rectangular portion 70 of the upper support 20, and a plurality of holes 248 through which screws (not shown) are driven to attach the lower support 25 to the upper support 20.

To attach the lower support 20 to the upper support 25, the lower support is slid over the post 15 before the upper support and then is raised into contact with the installed upper support 20 as described above. The lower support 25 is then screwed into the upper support 20 to join the upper and lower supports together.

The newspaper box 30 is rectangularly shaped with an open end 250 for the insertion of newspapers (not shown). The newspaper box 30 has a top wall 255, a pair of sidewalls 257, each sidewall having a groove 260, a back wall 265 and a bottom wall 270. The grooves 260 are adapted to receive the molded support ribs 240 on the lower support 25 side arms 235.

Figure 11:
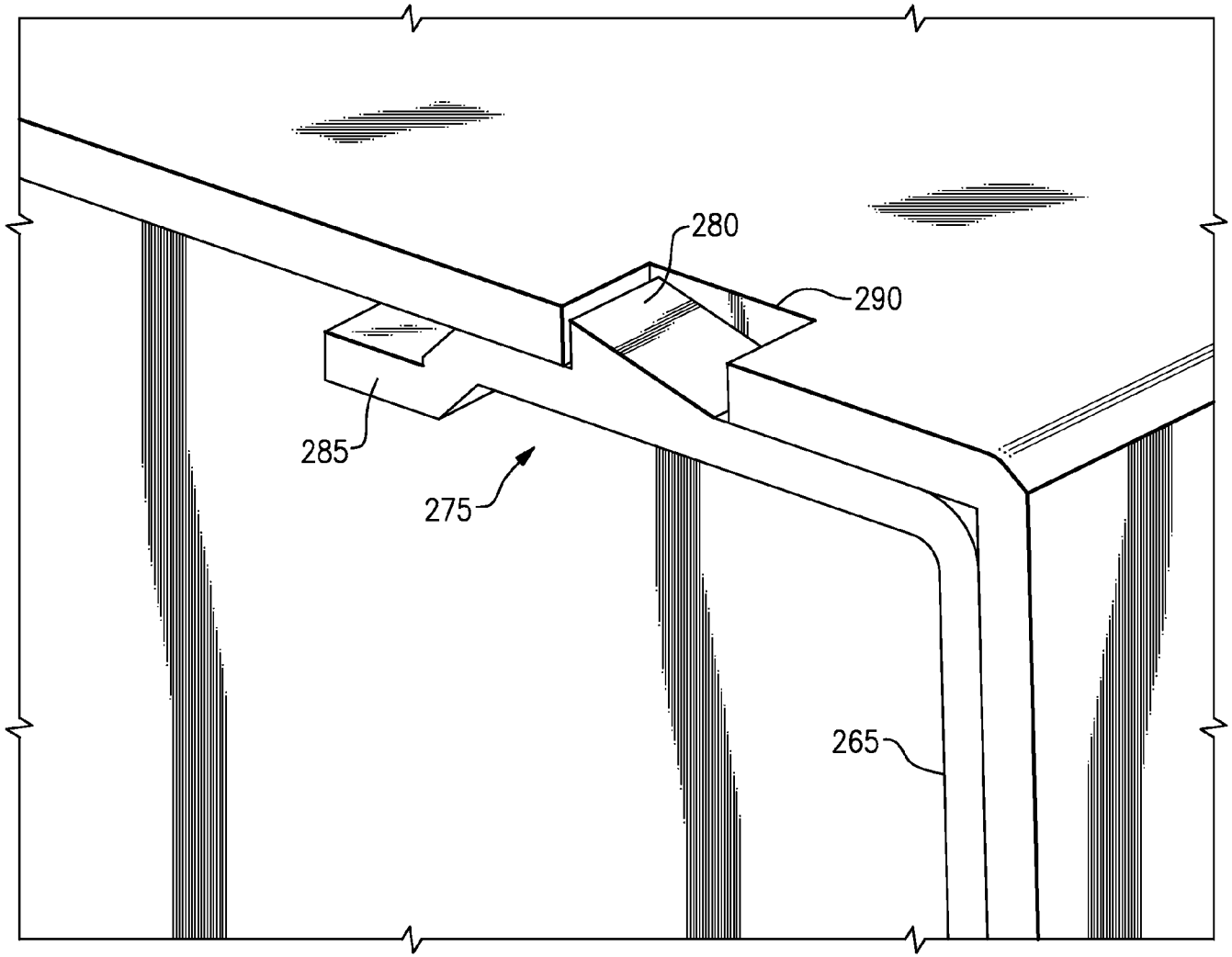
FIG. 11 is a perspective, cutaway view of an installed newspaper box of FIG. 9 installed in the lower support of FIG. 2

Referring to FIGS. 1, 9 and 11, a locking tab 275 extends from the back wall 265 of the newspaper box 30 parallel to the top wall 255 (see FIG. 9). The locking tab 275 has a chamfered extension 280 that increases in slope from the back wall towards a front of the newspaper box 30 and a lower portion 285 that is parallel to the top wall 255 but not in plane therewith. The chamfered extension fits in rectangular opening 290 in the top portion 245 of the lower support (see also FIG. 1) 25.

To install the newspaper box 30, grooves 260 are slid over the molded support ribs 240 until the chamfered extension 280 clicks into place in the rectangular opening 290 in the top portion 245 of the lower support 25. Because the lower locking tab 275 is flexible, if the removal of the lower mailbox from the newspaper box is desired, the user simply pushes down the lower portion 285 of the locking tab 275 until the chamfered extension 280 releases itself from the opening 290 and the newspaper box 30 may be slid out of the lower support 25.

Figure 12:
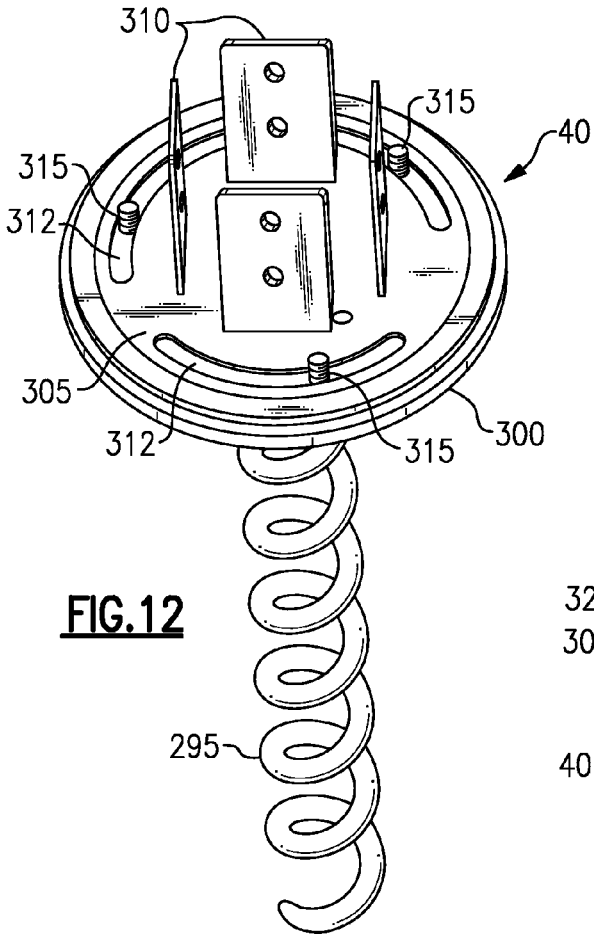
FIG. 12 is a perspective view of the mounting system of FIG. 1.
Figure 12A:
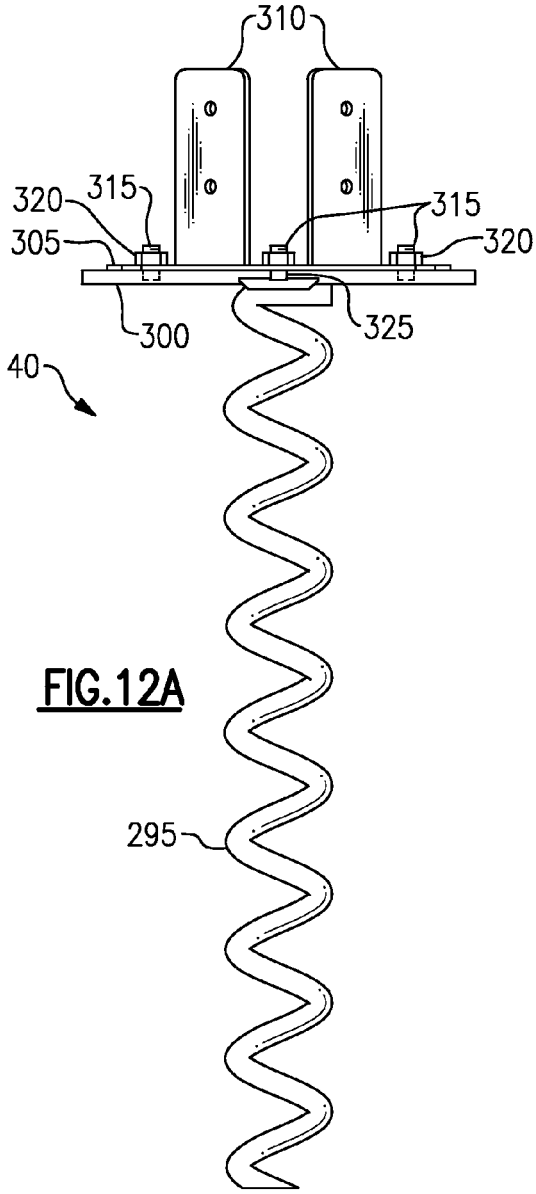
FIG. 12A is a perspective side view of the mounting system of FIG. 12.

Referring now to FIGS. 12 and 12A, the anchoring system 40 is shown. the anchoring system includes a screw 295, a circular lower plate 300, a circular upper plate 305 and a plurality of receiving fixtures 310. The upper and lower plates, the screw and the receiving fixtures 310 are made of a tough, long-lasting material such as steel or rugged plastic.

The upper plate 305 is designed to rotate about the lower plate and has three circular slots 312 extending therethrough. The slots extend far enough around the plate to enable an installer to properly orient the post 15 as will be discussed herein below. The receiving fixtures are welded to the upper plate 305.

The lower plate 300 has a plurality of bolts 315 that extend upwardly therefrom through the slots 312 in the upper plate 305. The bolts 315 extending through the slots in the upper plate have threaded top portions 320. The screw 295 is fixedly attached, such as by welding, to a bottom 325 of the bottom plate.

To install the anchoring system 40, an installer screws the screw into the ground (not shown). This can be achieved by joining the upper plate 305 with the lower plate 300 by fitting bolts 315 through the upper plate slots 312 and inserting a pry bar (not shown), in between the receiving fixtures 310 so that rotation of the pry bar around the axis of the screw 295 causes the upper plate to rotate about the lower plate until the lower plate bolts 315 hit the end of the slots 312. Once the end of the slots are hit, the lower plate 300 rotates with the upper plate 305 causing the screw to drive into the ground. Installation continues as the screw digs into the ground until the lower plate 300 touches the earth. Once the earth is touched, continuing to drill would compromise the soil beneath the lower plate that might, in turn, compromise the anchoring system 40.

In other systems, to get the proper orientation of their post, a user might let the screw dig into the ground farther thereby compromising the soil or too little, leaving the screw 295 open to the elements. In the non-limiting embodiment shown, once the lower plate 300 reaches the ground, the upper plate 305 and the receiving fixtures 315 can be properly oriented to hold the post 15 in the proper position by rotating the upper plate 305 about the lower plate 300 within the slots 312 until the proper position is obtained. Because of the orientation of the slots 312 and the number of receiving fixtures 310, the plate does not need to be rotated more than 90 degrees, though other numbers and shapes of receivers, extent of the slots and numbers of bolts are contemplated by this invention.

Once the upper plate is properly oriented, nuts 320 are torqued on the bolts 315 to prevent further rotation of the upper plate 300 relative to lower plate 295 thereby completing the construction. The receiving fixtures 315 are spaced on the upper plate 300 so that they can receive a 4×4 piece of wood (not show) or the like within the confines of the receiving fixtures or the post 15 is slipped down and over the receiving fixtures 315 and attached thereto from the outside by screws (not shown).

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed:

1. An apparatus for supporting a support, said apparatus comprising:

an attachment for attaching said support to the ground, a first plate fixedly attaching to said attachment, a second plate rotatably placed upon said first plate, a fixture attaching to said second plate for supporting said support and, an abutment for limiting rotation of said second plate relative to said first plate and for assisting in an installation of said attachment to said ground wherein said fixture is an upwardly extending support for attaching to a post.

2. The apparatus of claim 1, wherein said attachment is a screw.

3. The apparatus of claim 1 wherein either of said first or second plate has said abutment depending therefrom.

4. The apparatus of claim 3, wherein said abutment extends through a slot of the other of said first or second plate.

5. The apparatus of claim 4, wherein said slot has a circular shape to allow each of said first or second plate to rotate about the other of said first or second plate.

6. The apparatus of claim 3 wherein said abutment comprises a post.

7. The apparatus of claim 6 wherein said post further comprises a threaded portion such that rotation between the first plate and second plate may be limited if a nut is tightened on said bolt.

8. The apparatus of claim 1 wherein said fixture further comprises an array of fixtures.

9. The apparatus of claim 8 wherein said array of fixtures allow a post to be inserted over said array of fixtures.

10. The apparatus of claim 8 wherein said array of fixtures allow a post to be inserted within said array of fixtures.

11. A method for installing a support into the ground comprising:

placing a first plate on a second plate, said second plate having a screw for attaching the second plate to the ground, utilizing said first plate and said second plate to drive said attachment into the ground, rotating said first plate and said second plate relative to each other such that first plate is rotatably fixed to said second plate such that said screw is driven into the ground if said first plate is rotated, joining said first plate and said second plate such that said first and second plates may rotate relative to each other to properly orient said first plate, and orienting said first plate after said second plate contacts the ground.

12. The method of claim 11 further comprising joining said first plate and said second plate such that said first and second plates may rotate relative to each other to properly orient said first plate.

13. The method of claim 11 further comprising:

covering said first and second plate after installing said support.

* * * * *

UNITED STATES PATENT AND TRADEMARK OFFICE

CERTIFICATE OF CORRECTION

PATENT NO. : 8,235,347 B2
APPLICATION NO. : 12/564967
DATED : August 7, 2012
INVENTOR(S) : James Allen Austin, III et al.

It is certified that error appears in the above-identified patent and that said Letters Patent is hereby corrected as shown below:

ON THE TITLE PAGE:

Item [75] Inventor Patterson's information should read as follows:

--Charles A. Patterson, Durango, CO (US)--

Signed and Sealed this
Thirteenth Day of November, 2012

David J. Kappos

David J. Kappos
*Director of the United States Patent and Trademark Office*